United States Patent [19]

Weir

[11] Patent Number: 4,735,143

[45] Date of Patent: Apr. 5, 1988

[54] ADJUSTABLE STAMPING DEVICE

[75] Inventor: David A. Weir, Montecito, Calif.

[73] Assignee: Phoenix Endeavour, Inc., Ventura, Calif.

[21] Appl. No.: 909,758

[22] Filed: Sep. 19, 1986

[51] Int. Cl.[4] ..... B41K 1/56

[52] U.S. Cl. ..... 101/333; 101/364; 101/405

[58] Field of Search ..... 101/405, 406, 57, 94, 101/65, 371, 327, 368, 316, 363, 364, 350, 297, 333, 382 ML, 407 BP

[56] References Cited

U.S. PATENT DOCUMENTS

| | | | |
|---|---|---|---|
| 905,548 | 12/1908 | Mann | 101/316 |
| 1,512,085 | 10/1924 | Clary | 101/405 |
| 1,562,775 | 11/1925 | Leilich | 101/407 BP |
| 4,492,162 | 1/1985 | Nettesheim | 101/405 |
| 4,561,353 | 12/1985 | Chapman | 101/405 |

FOREIGN PATENT DOCUMENTS

| | | | |
|---|---|---|---|
| 623696 | 12/1935 | Fed. Rep. of Germany | 101/316 |

*Primary Examiner*—Clyde I. Coughenour
*Attorney, Agent, or Firm*—Marvin E. Jacobs

[57] ABSTRACT

An adjustable hand stamp device controls stamp compression of the ink bearing stamp element. The device includes an inverted cup-shaped handle connected to a platen by a shaft. A shroud slidably mounted on the shaft and biased downwardly by a spring positioned between the handle and the platen covers the platen and the indicia-bearing element mounted on the platen. The position of the shroud relative to the platen is controlled by the position of an eccentric cam positioned between a bearing surface on the shroud and a bearing surface on the inside of the handle. The cam is connected to an adjusting knob rotatably mounted on the front face of the handle.

12 Claims, 4 Drawing Sheets

ADJUSTABLE STAMPING DEVICE

DESCRIPTION

1. Technical Field

This invention relates to devices for imprinting stamp messages and, more particularly, this invention relates to a stamping device which adjustably prints a fixed message from a pre-inked stamp material.

2. Background Art

The fixed message stamp with custom or standard imprints is a necessary device in modern businesses, especially in bookkeeping, accounting, billing and mail handling. The earliest stamps were hard rubber, and they were inked from a pad before the message was transferred and imprinted on the document or package. However, the stamp was usually overinked and the excess ink would end up on the fingers, hands and clothing of the user. Also unnecessary and unwanted imprints were made on every surface that came in contact with the face of the stamp.

Recently, a pre-inked stamp element became available in which the ink was contained in micropores within a synthetic resin material as disclosed in U.S. Pat. Nos. 2,777,824, and 3,055,297, the disclosures of which are expressly incorporated herein by reference.

U.S. Pat. No. 3,625,143 is representative of patents disclosing a stamp device in which the message can be varied by rotation of a marking band of the microporous, synthetic resin material. However, the force of impression is variable depending on the force applied by each user and the quantity of ink present in the band. Consequently, the band expels varying amounts of ink often resulting in blurred or smeared marks. Also, the lifetime of the stamp element is shortened due to excessive wear caused by degeneration of the microporous material due to overly forceful compression of the element. Impressions made with too light a force will not form a dark, distinct image.

These problems are avoided by stamp device having means to adjust the impressive force. Such a hand stamp device is disclosed in U.S. Pat. No. 4,022,127. This device has a handle including a rotatable collar which engages an adjustable stop comprising a two-part bushing of variable length to vary the relative position of the inked, message element and the message receiving surface. This device provides clear, non-blurred impressions and assures that this pre-inked element has a long, service life. However, the adjustment collar is positioned just below the handle and can be inadvertently rotated during handling or use by pressure from the thumb of the user. Furthermore, this adjustable device is mechanically complex and contains numerous parts requiring separate manufacture. This device is expensive to manufacture and assemble and is subject to mechanical failure.

STATEMENT OF THE INVENTION

An improved, adjustable stamp device is provided in accordance with the invention which is simple in construction, economical to produce and is relatively immune to mechanical problems. The stamp device has a minimal number of parts and is constructed in a manner to provide maximum mechanical integrity by reducing the likelihood of breakage or failure. The manual stamp device permits selectable, variation of the impressive force applied to the ink-bearing element in a reliable manner. The device requires little, if any, maintenance and provides distinct, non-blurred impressions and long life to the stamp element. These advantages are preferably attained by providing a manual stamp device having a base for receiving an ink-bearing element, a shroud surrounding said base and slidably mounted on said handle to vary the impressive force applied to an ink-bearing member, resilient means urging said shroud to a first extended position, and cam means adjustably positionable to limit the length of movement of said shroud relative to said base when in a second retracted position.

The manual hand stamp of the invention has an extremely attractive appearance, preferably being formed of a curved handle joined by a short intermediate post to a base with a shroud having curved edges. The adjustment means preferably takes the form of a recessed, concave knob or button rotatably received in an aperture in the front or back face of the handle and is secured to the cam by adhesive or sonic, solvent or thermal welding. The knob has a slot for receiving a coin or other knife-edged implement which acts as a key for rotating the knob- cam assembly. The recessed knob also forms a convenient and comfortable location for resting or placing a thumb during a stamp impression.

The stamp of the invention is constructed of few parts and can be mass produced at low cost from mainly plastic materials. The stamp is more reliable and convenient to use. The stamp will be more efficient in an office atmopshere since it will not require repackaging, or redoing of documents that have been imprinted incorrectly or smudged.

These and many other advantages and features of the present invention will be apparent as the invention becomes better understood by reference to the following detailed description when considered in conjunction with the accompanying drawings.

DETAILED DESCRIPTION OF THE INVENTION

Figure 1:
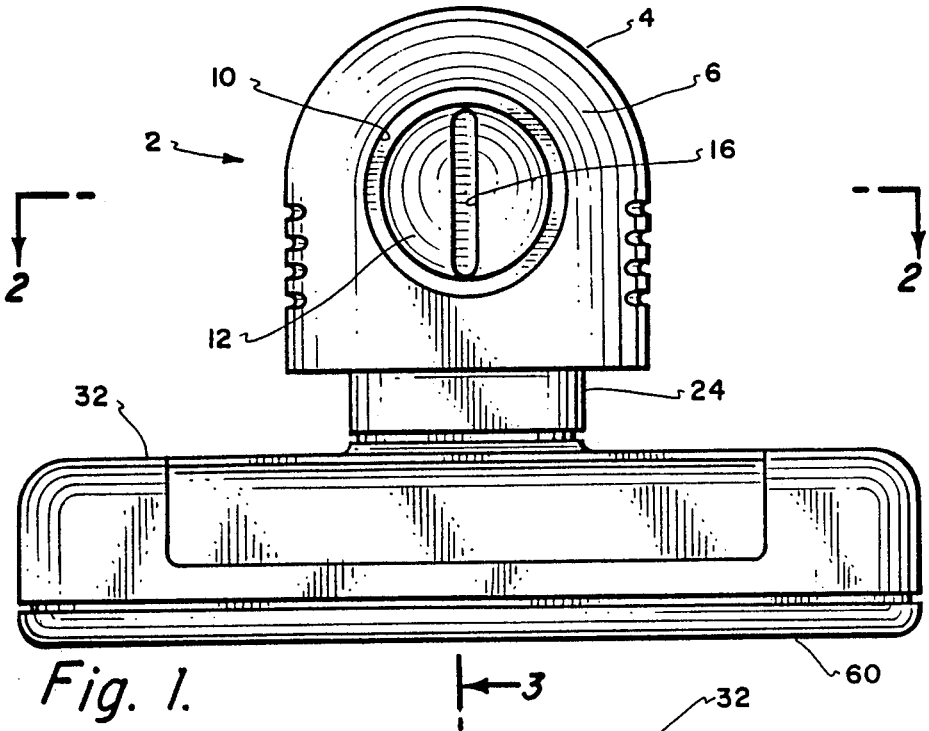
FIG. 1 is a front elevation view of a manual stamp device according to the present invention.
Figure 2:
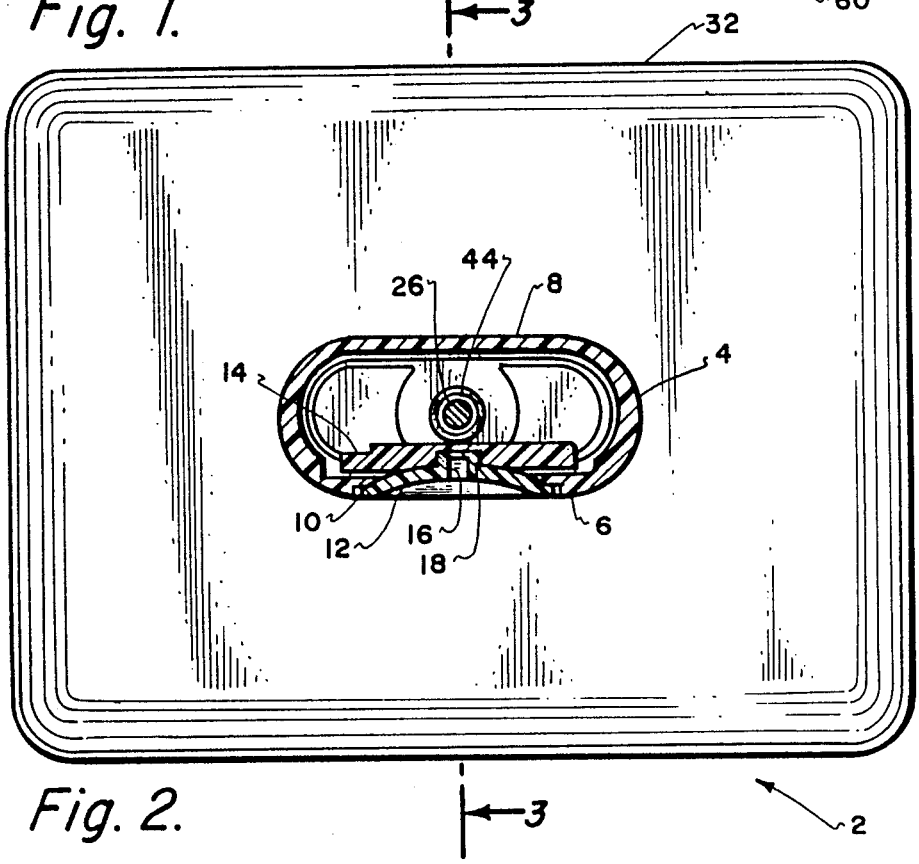
FIG. 2 is a horizontal section through the device of FIG. 1, taken on the line 2—2 thereof.

FIG. 1 shows a manual stamping device, indicated generally at 2, having a handle member 4 which is generally in the shape of an inverted cup with flat front and rear sides, as seen at 6 and 8, respectively, in FIG. 2. The front side 6 has an aperture 10 formed therein which rotatably receives an adjusting knob 12 having a concave face containing a recessed slot 16 which extends diametrically across the face of the adjusting knob 12. The slot 16 is sized to receive a coin, not shown. The knob 12 has a rearwardly facing hub 18 which is received in a corresponding recess in the front face of a cam wheel 14. The knob is secured to the cam 14 to form a unitary knob-cam assembly by adhesive or welding. When the coin is rotated in the slot 10, the coin will bear against the sides of the slot 16 and will rotate the knob-cam assembly to rotate the cam wheel 14 to a desired position.

Figure 3:
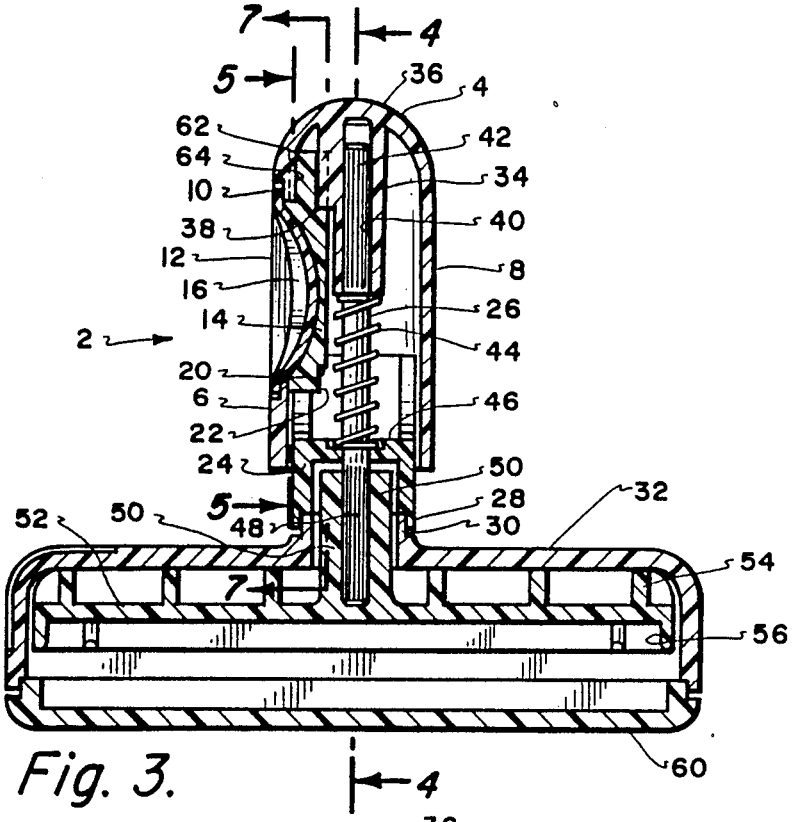
FIG. 3 is a transverse section through the manual stamp device of FIG. 1, taken on the line 3—3 of FIG. 2.
Figure 4:
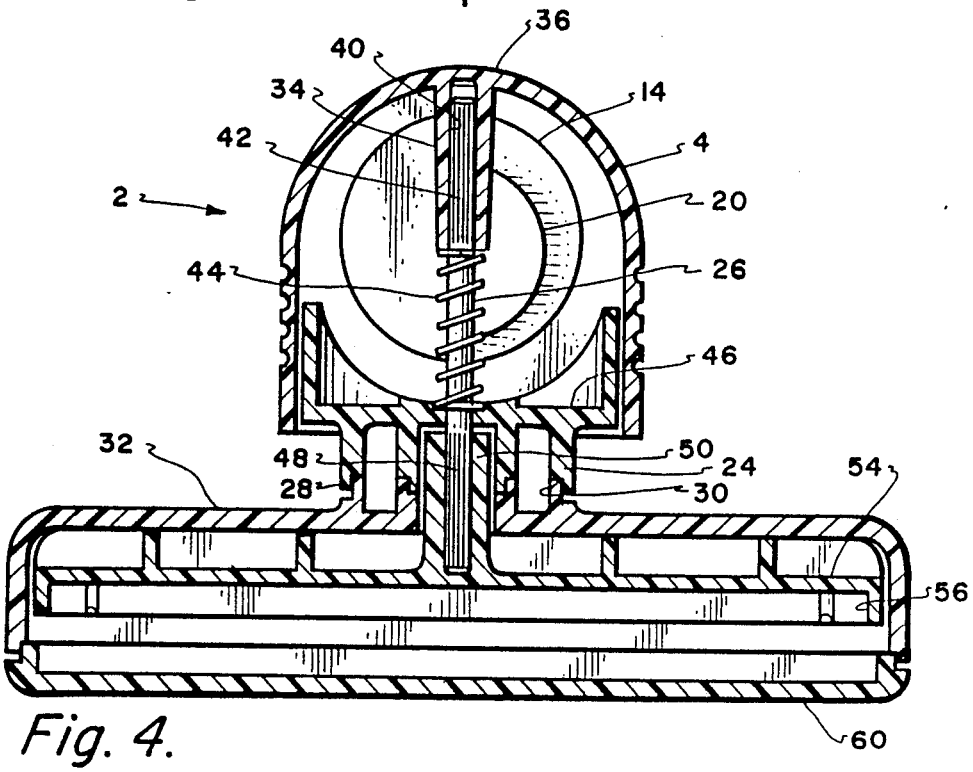
FIG. 4 is a vertical section through the manual stamp device of FIG. 1, taken on the line 4—4 of FIG. 3.

As seen in FIGS. 3 and 4, the rear surface of the cam wheel 14 is formed with an eccentric camming surface 20 which engages a shoulder 22 formed on a collar 24. The collar 24 is slidably mounted on a central shaft 26 and has a lower shoulder 28 which is fixedly secured to the upper shoulder 30 of a shroud member 32. The handle member 4 is formed with an internal boss 34 adjacent the closed upper end 36 thereof and the boss 34 is provided with a shoulder 38 which also engages the camming surface 20 of the cam wheel 14. The boss 34 is formed with an axial recess 40 which fixedly receives the upper end 42 of the shaft 26. A spring 44 is mounted on the shaft 26 between the lower end of the boss 34 and the inner surface 46 of the collar 24. The lower end 48 of the shaft 26 is fixedly secured within a central boss 50 which extends upwardly from the top surface 52 of a platen member 54. The platen member 54 is slidably received within the shroud member 32 and is formed with downwardly extending walls 56 for receiving and frictionally retaining a microporous stamp element, as shown at 58 in FIGS. 9 and 10. Finally, a dust cover 60 is frictionally retained by the shroud member 32 to protect the stamp member 58 and platen 54 from dirt or damage.

Figure 5:
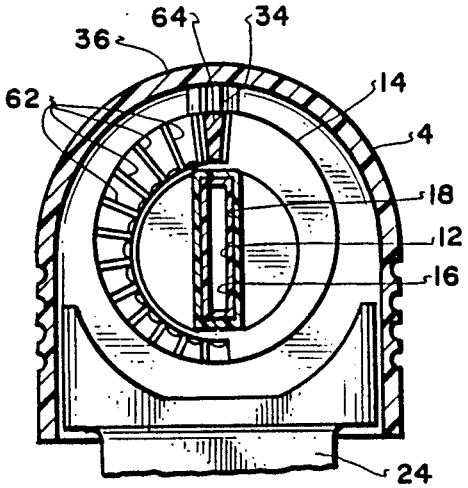
FIG. 5 is an enlarged detail view, partly in section and with a portion of the handle shown removed, of the upper portion of the manual stamp device of FIG. 1.
Figure 6:
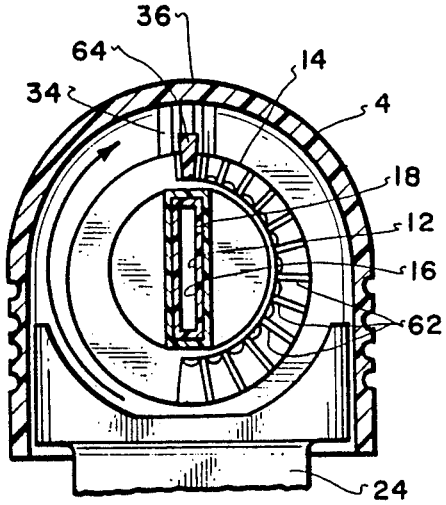
FIG. 6 is a view similar to that of FIG. 5 showing the cam member in an adjusted position.

As best seen in FIGS. 3, 5 and 6, the front surface of the cam wheel 14 is formed with a plurality of circumferentially disposed recessed 62 which are engagable by a detent 64 formed on the inside of the front surface 6 of the handle member 4. The detent 64 serves to engage the recesses 62 of the cam wheel 14 to retain the cam wheel in a desired position of adjustment.

Figure 7:
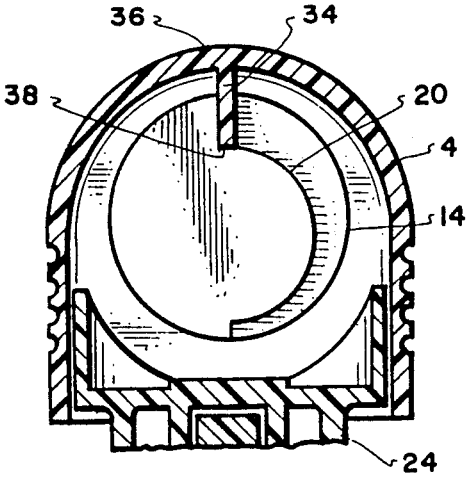
FIG. 7 is a view similar to that of FIG. 5 showing the reverse side of the cam member of the manual stamp device of FIG. 1.
Figure 8:
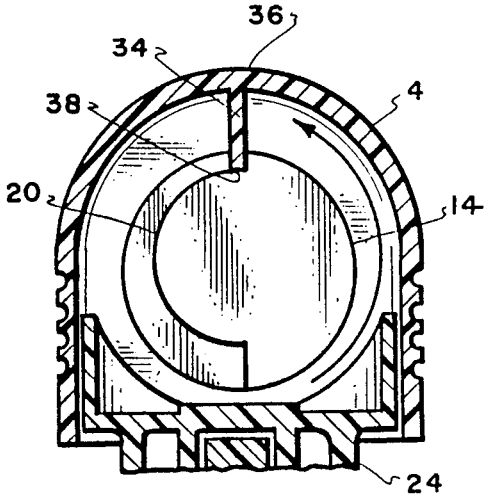
FIG. 8 is a view similar to that of FIG. 7 showing the cam member in an adjusted position.
Figure 9:
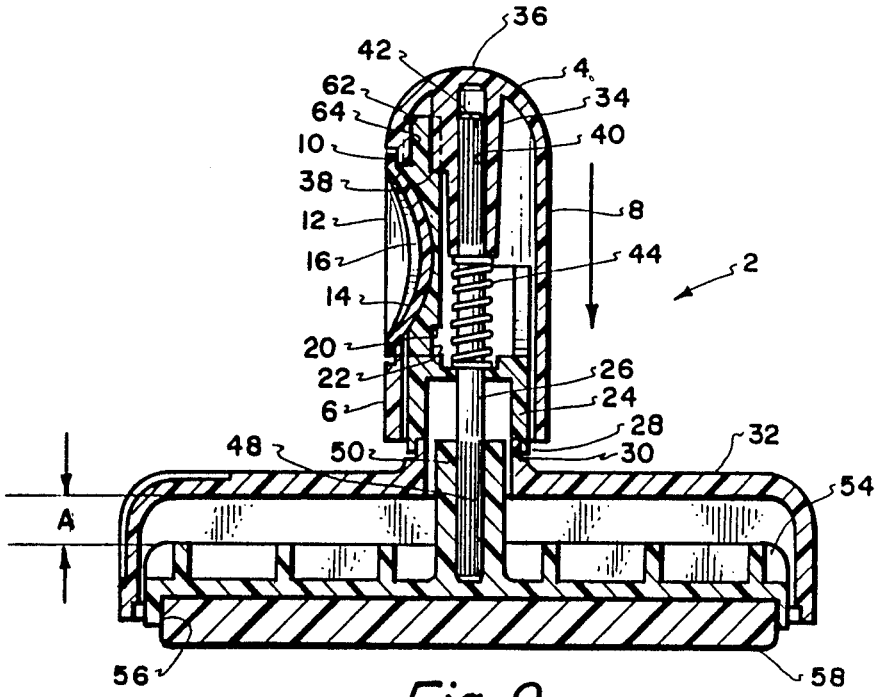
FIG. 9 is a view similar to that of FIG. 3 showing the shroud of the manual stamp device of FIG. 1 in its most retracted position.
Figure 10:
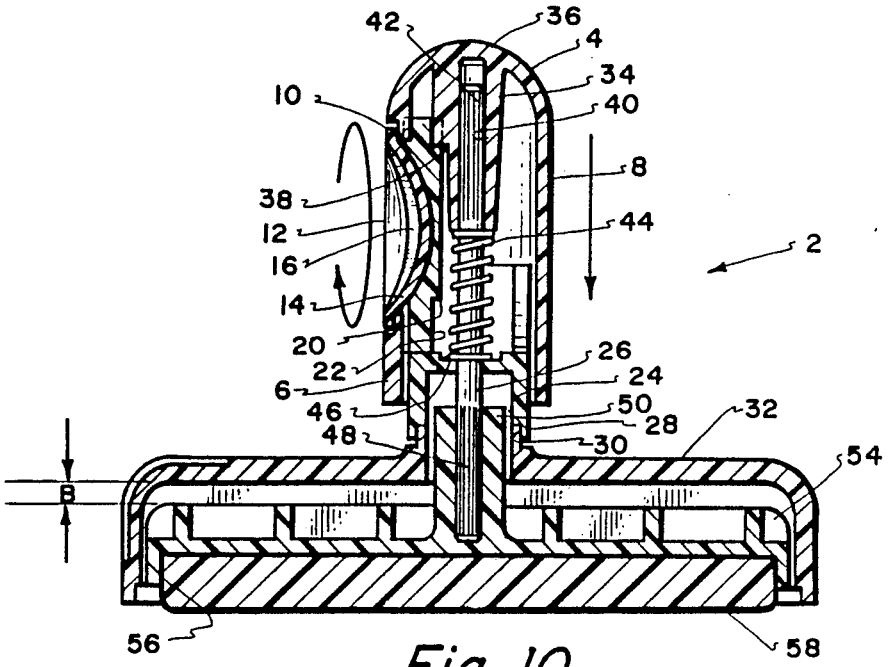
FIG. 10 is a view similar to that of FIG. 9 showing the shroud in its least retracted position.

In use, a coin is inserted into slot 16 of the adjusting wheel 12 to rotate the adjusting wheel 12 to a desired position. Since the adjusting wheel is fixedly secured to the cam wheel 14, rotation of the adjusting wheel 12 also rotates the cam wheel 14. As best seen in FIGS. 7 and 8, rotation of the cam wheel 14 serves to alter the position of camming surface 20 of the cam wheel 14 which bears against shoulder 38 of the boss 34 of handle member 4 and against shoulder 22 of the collar 24. This serves to selectively adjust the position of the shroud member 32 between a retracted position, as seen in FIG. 9 and an extended position, as seen in FIG. 10. The detent 64 of handle member 4 engages the recesses 62 of cam wheel 14 to retain the cam wheel 14 in the desired position When the coin is removed, the external portion of the knob mechanism is gone and there is no possibility of accidental rotation of the cam. When the manual stamp device 2 is employed to print its indicia on a desired surface, the shroud member 32 will first engage the desired surface and the platen member 54 will be forced downwardly until the movement of the platen member 54 is limited by the adjustment level provided by the coin. Only a selected thickness of the stamp element extends past the shroud. This provides a control on the amount of compression of the stamp element 58 carried by the platen member 54 as it engages a surface to make an imprint thereon.

When the device is removed from the surface, the spring 44 will expand and return the shroud 32 to its first, extended position in front of and protecting the stamp element from accidentally imprinting on a surface. When the cam wheel 14 is in the position shown in FIGS. 6 and 8, the camming surface 20 will allow the collar 24 and shroud 32 to retract to the position shown in FIG. 10. Accordingly, when an imprint is made with the device 2 so adjusted, the stamp element 58 will be compressed at its lowest level and the imprint made will be the lightest. In contrast, when the cam wheel 14 is in the position shown in FIGS. 5 and 7, the camming surface 20 will allow the maximum movement of the platen member 54. Hence, the platen member containing the stamp element 58 will have its longest travel or throw and will engage the surface to be imprinted with the highest amount of compression. The resulting imprint made by the stamp element 58 will be relatively dark. Obviously, intermediate positions of the cam wheel 14 will result in intermediate darkness of the imprint made by the stamp element 58.

As described above, the adjustment knob 12 is formed with a slot 16 which is sized to receive the edge of a coin, not shown. The coin, then, serves as a handle to rotate the adjustment wheel 112 and, hence, the cam wheel 14 to a desired position. On the other hand, it will be obvious to those skilled in the art that the adjustment knob 12 could, if desired, be provided with suitable handle means secured to or formed integral with the knob.

The stamp device is assembled by inserting the lower knurled end of the shaft into the boss on the platen. The shroud, collar and spring are placed on the shaft. The knob is adhered to the cam wheel and the cam wheel is snappedinto the aperture on the front surface of the handle. The upper end of the shaft is inserted into the aperture in the boss inside the handle.

The stamp device can be formed of many different materials such as metal or high impact plastic. However, all parts except for the spring an shaft can be formed of plastic. The stamp contains few parts, is lightweight, yet sturdy and reliable. It is convenient to use and gives longer useful life to the stamp element since extraneous imprints are avoided due to the retractable shroud. The element will also last longer since it is subjected to controlled compressive force, is protected by the cover when not in use and will not dry out as quickly and will not be chipped or cracked as readily.

It is to be realized that only preferred embodiments of the invention have been described and that numerous substitutions, modifications and alterations are permissible without departing form the spirit and scope of the invention as defined in the following claims.

I claim:

1. A manual stamp device comprising in combination:
   - a platen member for receiving an ink-bearing stamp element;
   - a hollow handle having relatively flat front and rear walls;
   - a rod securing the handle to the platen member;
   - a shroud member having a first downward skirt portion surrounding the platen and an upper neck portion connected thereto slidingly received in the lower end of the hollow handle, said neck having a top surface with an aperture for passage of the rod;

spring means mounted on the rod above the neck for biasing the shroud downwardly;

a circular aperture formed in the front surface of the handle;

a circular adjustment disc rotatably mounted in the aperture;

a cam having an eccentric curvilinear, surface secured to the rear surface of the disc having a curvature such that rotation of the cam on said disc results in a varying vertical distance from the top edge of the cam to the lower edge of the cam whereby when vertical pressure is applied to the handle, the retraction of the shroud is controlled by the contact of the top surface of the neck portion with the bottom edge of the cam.

2. A stamp device according to claim 1 in which the spring means comprises a coil spring mounted on the rod and the aperture in the top of the neck portion is surrounded by a countersunk recess for receiving the lower edge of the spring.

3. A stamp device according to claim 1 in which the sides of the handle are curved and in which the neck portion contains two upstanding curved guide arms slidingly engaging the inner surfaces of the sides of the handle.

4. A stamp device according to claim 3 in which the adjustment disc has a concave surface.

5. A stamp device according to claim 4 in which the concave surface contains a straight slot for receiving the edge of a coin to facilitate rotation of the disc.

6. A stamp device according to claim 1 further including means for selectably limiting rotation of the cam.

7. A stamp element according to claim 6 in which the selective means includes a plurality of radial ribs formed on the outside surface of the cam and a tap member mounted on the inside surface of the handle for releasably engaging the ribs.

8. The manual stamp device according to claim 1 further including an indicia bearing stamp element secured to the surface of the platen means.

9. The stamp device according to claim 8 in which the element is formed of microporous synthetic resin and contains ink.

10. A manual stamp device comprising:

a handle generally in the form of an inverted cup having a closed upper end, an open lower end and relatively flat front and rear walls, a circular aperture formed in the front wall, detent means formed on the inside surface of the front wall to the handle adjacent the aperture, a circular disc rotatably mounted in said aperture; and a boss portion projecting inwardly from the closed end of the handle means and formed with a peripheral shoulder adjacent the aperture and having a recess extending axially from the free end of the boss portion;

a platen member formed to support an indiciabearing stamp element;

a shaft projecting perpendicular to the upper surface of the platen member and having its opposite end fixedly secured within the recess of the boss portion of the handle;

a shroud slidably mounted on the shaft extending about said platen member and having a skirt portion movable from an extended downward position and a retracted, upward position permitting a stamp element carried by said platen member to impressively engage a surface to be imprinted;

resilient means carried by the shaft and extending between said boss portion and said shroud means to urge the shroud to its extended position; and a cam mounted on the disc within the handle adjacent the aperture having an eccentric curved surface engaging the shoulder of the boss portion of the handle and the shroud and rotatably positionable to selectably limit the retracting movement of the shroud.

11. The manual printing device of claim 10 wherein:

the cam comprises a camming wheel positioned within the handle between said detent and said boss portion formed with a plurality of recesses disposed circumferentially about the periphery of the camming wheel and selectably engagable with said detent to selectably determine the rotational position of said camming surface and thereby selectably limit the retracted position of said shroud.

12. The manual printing device of claim 11 in which the outside surface of the disc includes:

a slot extending diametrically across the outer face of said disc sized to receive the edge of a coin.

* * * * *